US006998524B2

(12) United States Patent
Teuffel

(10) Patent No.: US 6,998,524 B2
(45) Date of Patent: Feb. 14, 2006

(54) ELECTRIC GUITAR

(76) Inventor: Ulrich Teuffel, Weissenhorner Strasse 13. D-89233, Neu-Ulm (DE)

( * ) Notice: Subject to any disclaimer, the term of this patent is extended or adjusted under 35 U.S.C. 154(b) by 0 days.

(21) Appl. No.: 10/492,159

(22) PCT Filed: Oct. 5, 2002

(86) PCT No.: PCT/EP02/11196

§ 371 (c)(1),
(2), (4) Date: Apr. 9, 2004

(87) PCT Pub. No.: WO03/034400

PCT Pub. Date: Apr. 24, 2003

(65) Prior Publication Data

US 2004/0244569 A1 Dec. 9, 2004

(30) Foreign Application Priority Data

Oct. 11, 2001 (DE) ..... 201 16 699

(51) Int. Cl.
*G10D 3/00* (2006.01)

(52) U.S. Cl. ..... 84/291

(58) Field of Classification Search ..... 84/290, 84/291

See application file for complete search history.

(56) References Cited

U.S. PATENT DOCUMENTS

| | | | | |
|---|---|---|---|---|
| 3,769,871 | A | 11/1973 | Cawthorn | |
| 4,103,583 | A | 8/1978 | Takabayashi | |
| 4,915,003 | A * | 4/1990 | Clough | 84/291 |
| 5,889,221 | A * | 3/1999 | Dejima | 84/291 |
| 6,646,189 | B1 * | 11/2003 | Minakuchi | 84/291 |
| 6,774,291 | B1 * | 8/2004 | Vartiainen | 84/291 |

FOREIGN PATENT DOCUMENTS

| | | |
|---|---|---|
| DE | 26 44 566 A | 4/1978 |
| DE | 299 06 537 | 8/1999 |
| GB | 2 045 993 A | 11/1980 |

* cited by examiner

*Primary Examiner*—Jeffrey W Donels
(74) *Attorney, Agent, or Firm*—Venable LLP; Robert Kinberg; Steven J. Schwarz

(57) ABSTRACT

The invention concerns an electric guitar comprising a body (1), a neck (2) fixed to the body and a scroll (3) located at the free end of the neck (2). The body (1) consists of a base body, an upper cache which covers the front side of the base body and is provided with an orifice for the chord support (5), and a lower cache which covers the rear side of the base body. The base body bears the chord support (5), the read head(s) and the connection socket (7) for the amplifier cable.

11 Claims, 3 Drawing Sheets

ELECTRIC GUITAR

Figure 1:
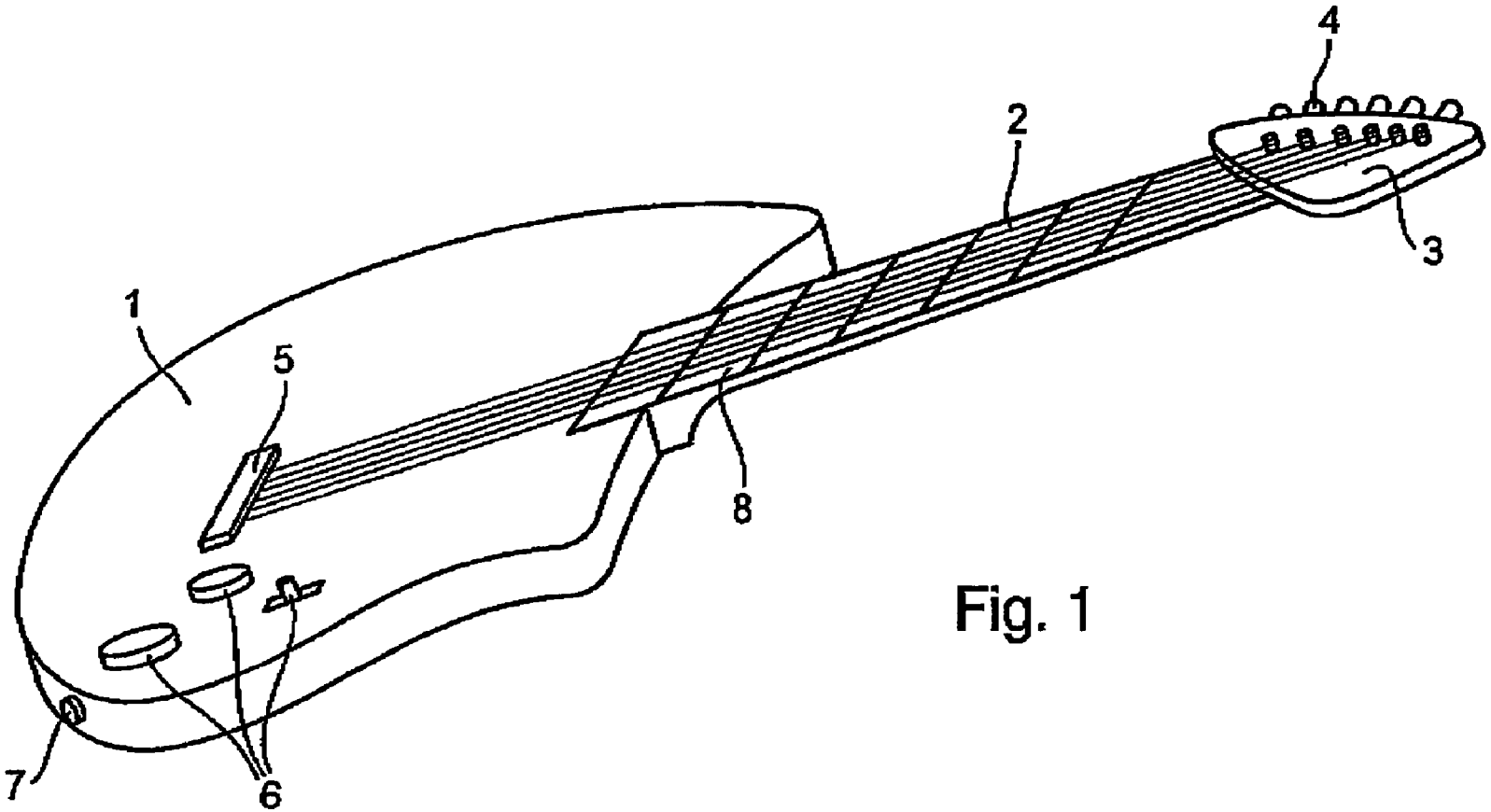

The invention relates to an electric guitar comprising a body, a neck affixed to the body and a headstock arranged on the free end of the neck.

Electronic instruments have been an established feature in the music industry for some years, wherein electric guitars in particular have become popular. The basic design of electric guitars corresponds to the design of traditional acoustic guitars. Electric guitars essentially consist of a body, a neck, a fingerboard, a headstock and a tuning machine.

In contrast to acoustic guitars with a hollow resonance body, electric guitars have a massive body. In addition to the chord support, the body also comprises the sound pickup(s) as well as additional selection switches and controls, if necessary, and a jack for connecting to an amplifier cable.

The string vibrations that are manually generated by the player are picked up by a sound pickup and converted to an electric sound signal. This signal is conducted via the amplifier cable to an amplifier which electrically amplifies the sound signal and plays it back over a loudspeaker.

The body decisively influences the sound characteristic of the electric guitar. Besides the material used, the body dimensions in particular influence the acoustic qualities. The shape of the body on the other hand plays a rather subordinate role for the acoustics. The body shape and design are primarily influenced by pure design concepts or determined by ergonomic aspects. However, a certain mass is a precondition for a full guitar sound.

Nowadays, electric guitars are mass-produced by the industry, wherein the outer shape is for the most part fixed and only the color of the electric guitar can be varied easily. However, having a fixed design of this type runs counter to the musician's tendency to individualize. Each musician also wants to distinguish himself/herself if possible with respect to his/her guitar from other musicians. The selection of a different body, however, directly results in a change in the sound characteristics of the electric guitar. In addition, changing the shape at a later date is not possible at all.

Coupling the sound-determining characteristics and outer shape of the body has proven to be a disadvantage. The production of differently designed bodies with the same acoustic characteristics is economically not possible and can be achieved only with an expensive and involved design and development process.

It is the object of the present invention to create an electric guitar for which the outer shape can be varied and/or changed easily, without this influencing the sound characteristics.

This object can be solved with an electric guitar having a body that consists of a basic body with the chord support, the sound pickups and the cable-connection jack, an upper shell that covers the front of the basic body and is provided with an opening for the chord support and a lower shell that covers the back of the basic body.

For this three-part body, the basic body is enclosed by the upper shell and the lower shell, thus creating a separation between the basic body that determines the acoustics and the form elements. As a result, a large number of variants of the electric guitar can be produced, which all use the same basic body. For this purpose, only the upper and lower shell that provide form and color must be changed. From a production-technical point of view, this results in an extremely cost-effective method since large numbers of the uniform basic body can be produced.

Since the massive basic body is enclosed by the upper and lower shell, its appearance plays a subordinate role and there is no need to sand, varnish or specially process it.

According to the invention, the upper shell is provided with an opening for the chord support to project through the upper shell. The guitar strings thus can extend from the chord support above the upper shell along the neck up to the tuning machine on the headstock.

According to one preferred embodiment, the upper shell and the lower shell are provided with a peripheral edge, wherein the edges of the upper shell and the lower shell are arranged so as to adjoin and fit together. Thus, it is ensured that the basic body is completely enclosed.

It is particularly advantageous if the upper shell and the lower shell are detachably connected to the basic body. As a result, the upper shell as well as the lower shell can be removed from the basic body and can be replaced even after the electric guitar is completely finished. Above all, this provides the user with the option of changing the appearance of his/her electric guitar at a later date and to adapt it to his/her individual wishes. The detachable upper and lower shells can furthermore be replaced if they are damaged, without having to replace the complete electric guitar.

The upper shell and/or the lower shell are advantageously provided with a recessed area for the neck. This recessed area can also be provided only in the upper shell or only in the lower shell in case of a non-symmetrical arrangement of the neck on the basic body. With a symmetrical arrangement of the neck on the basic body, the upper shell as well as the lower shell can be provided with a recessed area. The recessed areas also make it possible for the upper and lower shells to completely enclose the basic body at the neck-joining location, such that they precisely fit around the neck.

According to an especially preferred embodiment, the upper shell has additional openings for control elements and the cable connection jack. Control elements such as selecting or regulating switches, which are located on the basic body, project through the openings in the upper shell and can thus be operated by the player without having to remove the upper shell from the basic body.

According to one preferred embodiment, the upper shell and the lower shell are made from synthetic material, which is a low-cost material that can be molded, can be colored easily, and can be produced cheaply. By using synthetic material for the upper and lower shells, no limits are set to the creative freedom and nearly all shapes can be realized. In the same way, the color of the synthetic material can be adjusted to meet the wishes of the artist by inserting color particles or through a coat of varnish. Furthermore, the option exists of using a transparent synthetic material material, so that the basic body of the electric guitar, including all technical components, remains visible.

To connect the lower shell and the upper shell to the basic body, connecting elements are advantageously used which extend through bores in the lower shell and corresponding bores in the basic body and which engage in correspondingly arranged blind holes in the upper shell. With this type of arrangement, the connecting elements are accessible from the outside but remain invisible from the front of the electric guitar, so that a normal holding of the electric guitar when it is played gives the impression of a one-piece body.

Screws are preferably used as connecting elements. Screws create a reliable connection and can be loosened and tightened again repeatedly, without changing their mechanical characteristics.

The basic body of the electric guitar according to the invention can have an optional shape, for example the shape of a rectangular cube. A cube-shaped basic body can be produced particularly easily and cost-effectively, in particular with the mass-production method where several basic bodies can be produced with little waste from one flat board. This advantage has proven to be especially positive when producing basic bodies made from wood or coal-fiber reinforced synthetic material.

The headstock advantageously supports a cover shell that contains openings for the tuning machine. This cover shell represents a different design element which contributes to the individualization of the electric guitar. The cover shell can have an optional shape, in the same way as the upper shell and the lower shell. The form and/or color of this shell can be adapted to the design of the upper and/or lower shell. The openings in the cover shell make it possible to operate the tuning machine for the guitar strings without problems. Since the tuning machine remains freely accessible, the form of the cover shell must not necessarily correspond to the form of the headstock. This results in a larger number of options for varying the design of the cover shell, without harming the technical functionality of the electric guitar and its acoustics. In addition, the cover shell can also comprise notched areas for the strings, thus keeping the strings in their positions.

It is particularly advantageous if the cover shell is connected detachably to the headstock. As a result, the cover shell can be removed from the headstock, such that it can be replaced if damaged, or to change its optical design at a later date, for example to adapt it to a changed upper shell of the basic body.

Figure 2:
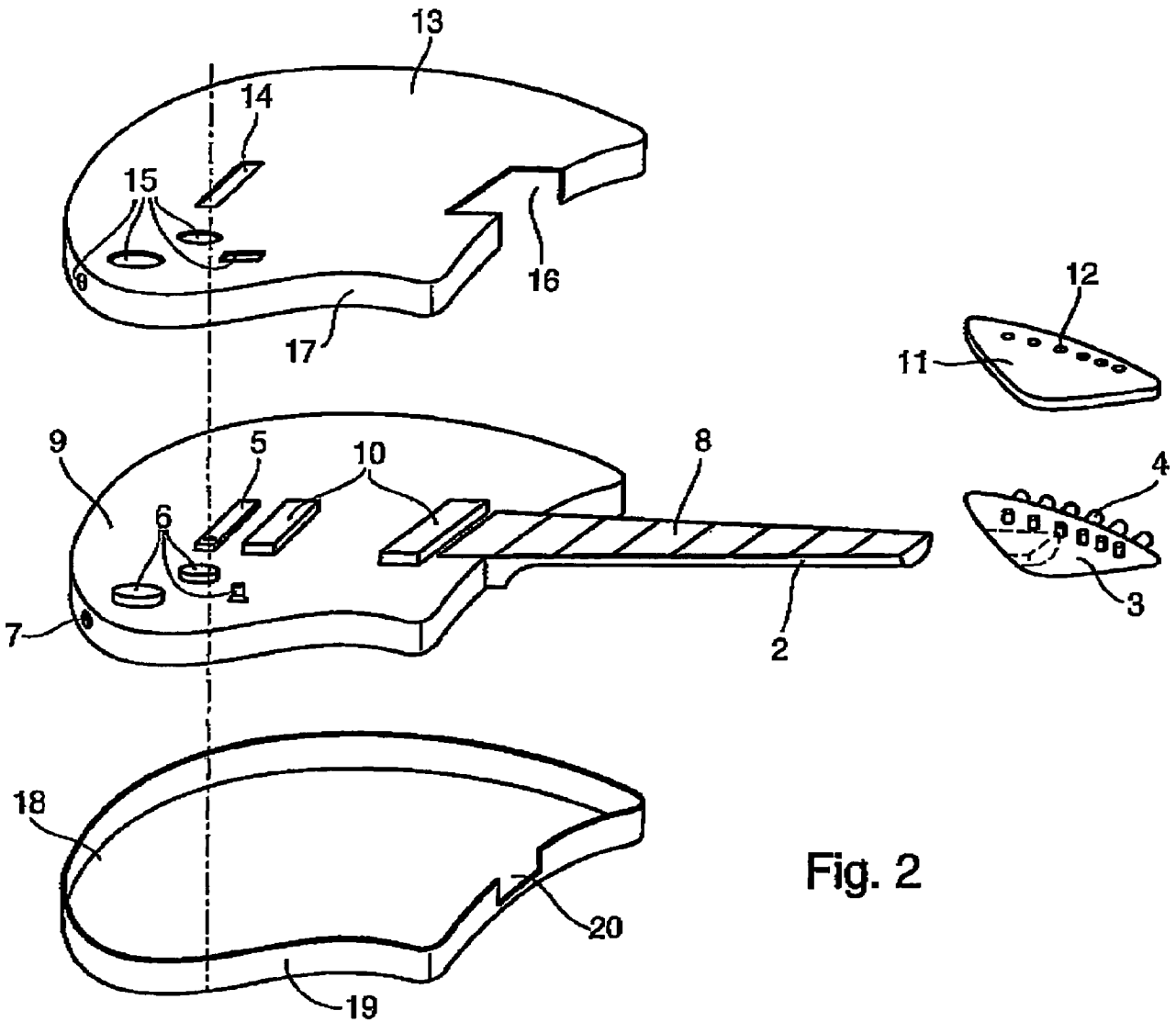

In the following, an exemplary embodiment of the invention is explained with the aid of the enclosed drawings, which show in:

FIG. 1 An electric guitar in a perspective total view;

FIG. 2 An exploded view of the electric guitar shown in FIG. 1 and

Figure 3:
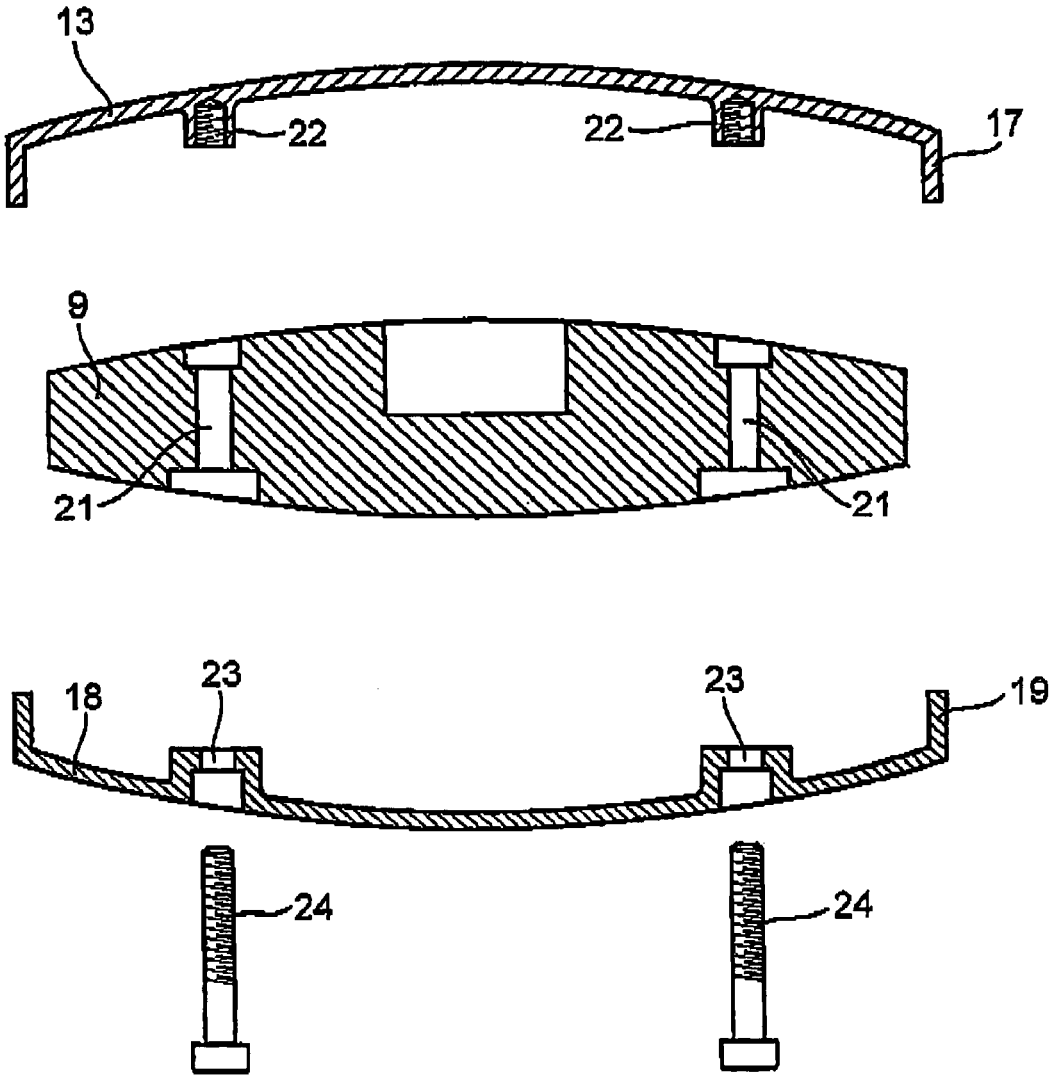

FIG. 3 A cross section through the body shown in FIG. 2.

According to FIG. 1, the electric guitar comprises a body 1 with a neck 2 attached thereto. A headstock 3 that carries a tuning machine 4 is arranged at the free end of neck 2.

A chord support 5 and several operating elements 6 are arranged on the top of the body 1. On the narrow side, the body 1 is provided with a connecting jack 7 for plugging in an amplifier cable.

The neck 2 which is fixedly connected to the body 1 is provided on the top with a fingerboard 8 that is divided multiple times. Five guitar strings extend above the fingerboard 8, which are held by the chord support 5 and are tensioned at the free end of the neck 2 with the aid of the tuning machine 4 that is arranged on the headstock 3.

FIG. 2 shows a basic body 9 with the chord support 5, several control elements 6 and two sound pickups 10. The connecting jack 7 for the amplifier cable is arranged at the narrow front side of basic body 9.

The headstock 3 supports a cover shell 11 provided with several openings 12. The tuning machine 4 projects through the openings 12 and can thus be operated by the user.

An upper shell 13 covers the top of the basic body 9 completely. The upper shell 13 is provided with an opening 14 through which the chord support 5 projects. Additional openings 15 are arranged in the upper shell 13 in such a way that they match up with the control elements 6 and the connecting jack 7 for the amplifier cable. The control elements 6 project through the upper shell 13.

In the region where the neck 2 is attached to the basic body 9, the upper shell 13 is provided with a recessed opening 16. As a result, the upper part of the neck 2 is enclosed precisely fitting by the upper shell 13.

A peripheral edge 17 extends along the bottom side of the upper shell 13, wherein the peripheral edge 17 covers one half of the side of basic body 9.

The lower shell 18, which is also provided with a peripheral edge 19, fits against the underside of basic body 9. The edge 19 corresponds to the edge 17 of the upper shell 13 and encloses the second half of the narrow sides of the basic body 9. The upper shell 13 and the lower shell 18 can be joined in such a way that their peripheral edges 17 and 19 abut and the basic body 9 is completely enclosed.

The lower shell 18 is provided with an opening 20 through which the neck 2 extends, so that the lower portion of the neck 2 is enclosed precisely fitting by the opening 20.

FIG. 3 shows a detailed section through the body 1. The basic body 9 is provided with two through bores 21. The upper shell 13 contains two blind holes 22, which coincide with the bores 21 of the basic body 9. The lower shell 18 is provided with two through bores 23 which are aligned with the bores 21 of the basic body 9.

Two connecting screws 24 extend through the bores 23 of the lower shell 18 and through the bores 21 of the basic body 9 and engage in the blind holes 22 of the upper shell 13.

FIG. 3 clearly shows that the upper shell 13 covers the upper half of the basic body 9. The peripheral edge 17 covers half of the sides of basic body 9. The lower shell 18 covers the lower half of the basic body 9, so that the basic body 9 is completely enclosed by the upper shell 13 and the lower shell 18.

List of Reference Numbers

1 body
2 neck
3 headstock
4 tuning machine
5 chord support
6 control elements
7 connecting jack
8 fingerboard
9 basic body
10 sound pickup
11 cover shell
12 opening (in 11)
13 upper shell
14 opening
15 openings (in 13)
16 recessed area (in 13)
17 peripheral edge (of 13)
18 lower shell
19 peripheral edge (of 18)
20 recessed area (in 18)
21 bores (through 9)
22 blind holes (in 13)
24 connecting screws

What is claimed is:

1. An electric guitar, comprising a body; a neck that is attached to the body and a headstock that is arranged on the free end of the neck, wherein the body comprises:

a basic body with a guitar string, a sound pickup(s) and a connecting jack for an amplifier cable, an upper shell that covers a front of the basic body and is provided with an opening for the guitar string, the upper shell is provided with a peripheral edge which extends along the bottom side of the upper shell, a lower shell that covers a back side of the basic body, and the lower shell is provided with a peripheral edge which extends along the upper side of the lower shell; and connecting elements, which extend through bores in the lower shell and through bores in the basic body and engage in blind holes in the upper shell.

2. The electric guitar according to claim 1, wherein the connecting elements are screws.

3. The electric guitar according to claim 2, wherein the basic body is in the form of a cube.

4. The electric guitar according to claim 3, wherein the headstock is provided with a cover shell that contains openings for a tuning machine.

5. The electric guitar according to claim 4, wherein the cover shell is detachably connected to the headstock.

6. An electric guitar, comprising a body;

a neck that is attached to the body and a headstock that is arranged on a free end of the neck, wherein the body comprises:

a basic body with a guitar string, sound pickup(s)

and the connecting jack for the amplifier cable, an upper shell that covers the front of the basic body and is provided with an opening for the guitar string and a lower shell that covers the back side of the basic body; wherein the upper shell and the lower shell are detachably connected to the basic body;

wherein at least one of the upper shell or the lower shell is provided with a recessed opening for the neck;

wherein the upper shell is provided with openings for control elements; and wherein the connecting elements extend through bores in the lower shell and through bores in the basic body and engage in blind holes in the upper shell.

7. The electric guitar according to claim 6, characterized in that the upper shell and the lower shell are made of synthetic material.

8. The electric guitar according to claim 6, characterized in that the connecting elements are screws.

9. The electric guitar according to claim 6, characterized in that the basic body is in the form of a cube.

10. The electric guitar according to claim 9, characterized in that the headstock is provided with a cover shell that contains openings for the tuning machine.

11. The electric guitar according to claim 10, characterized in that the cover shell is detachably connected to the headstock.

* * * * *